US007856186B2

(12) United States Patent
Eom

(10) Patent No.: US 7,856,186 B2
(45) Date of Patent: Dec. 21, 2010

(54) IMAGE FORMING APPARATUS AND POWER CONTROL METHOD THEREOF

(75) Inventor: Yoon-seop Eom, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 447 days.

(21) Appl. No.: 11/942,092

(22) Filed: Nov. 19, 2007

(65) Prior Publication Data

US 2008/0124094 A1 May 29, 2008

(30) Foreign Application Priority Data

Nov. 27, 2006 (KR) ..... 10-2006-0117712

(51) Int. Cl.
*G03G 15/00* (2006.01)

(52) U.S. Cl. ..... 399/9

(58) Field of Classification Search ..... 399/9, 399/111, 12, 13, 21, 99, 90, 124, 125
See application file for complete search history.

(56) References Cited

U.S. PATENT DOCUMENTS 5,332,208 A * 7/1994 Tsuji et al. ..... 271/171
5,708,922 A * 1/1998 Azuma et al. ..... 399/111
2004/0096228 A1 * 5/2004 Hoberock et al. ..... 399/21
2006/0226801 A1 10/2006 Yoo

FOREIGN PATENT DOCUMENTS

| | | |
|---|---|---|
| EP | 1881375 | 1/2008 |
| JP | 6-83130 | 3/1994 |
| JP | 2001-272892 | 10/2001 |
| JP | 2002-202698 | 7/2002 |
| JP | 2006-159740 | 6/2006 |
| KR | 2005-15237 | 2/2005 |

OTHER PUBLICATIONS

European Search Report dated Oct. 6, 2010, issued in European Patent Application No. 07121231.0.

* cited by examiner

*Primary Examiner*—David P Porta
*Assistant Examiner*—Kiho Kim
(74) *Attorney, Agent, or Firm*—Staas & Halsey LLP

(57) ABSTRACT

An image forming apparatus including: a body; an electronic unit; a replaceable unit that is detachably installed within the body; a power supply that generates and outputs a predetermined operation voltage; a high voltage generating part that receives the operation voltage and generates and outputs a high voltage; an electronic unit driving part that receives the operation voltage and regulates a driving voltage supplied to the electronic unit; and a controller that controls the power supply to cut off the operation voltage if the replaceable unit is not installed within the body. Also taught is a method of operating the image forming apparatus.

20 Claims, 5 Drawing Sheets

IMAGE FORMING APPARATUS AND POWER CONTROL METHOD THEREOF

CROSS-REFERENCE TO RELATED APPLICATIONS

This application claims the benefit of Korean Application No. 2006-0117712, filed Nov. 27, 2006, in the Korean Intellectual Property Office, the disclosure of which is incorporated herein by reference.

BACKGROUND OF THE INVENTION

1. Field of the Invention

Aspects of the present invention relate to an image forming apparatus and a power control method thereof.

2. Description of the Related Art

In general, an image forming apparatus, which employs an electrophotographic process forms an electrostatic latent image, on an organic photoconductor (OPC), using a laser beam and then forms an image on a print medium by applying toner to the electrostatic latent image. In order to apply the toner to the electrostatic latent image, the OPC is electrified with positive (+) charges. To this end, a high voltage of several hundred volts is typically applied to the OPC.

International Safety Standards, such as those from UL (Underwriters Laboratories), recommend that users should not be exposed to an electric current of more than 2 mA. This recommendation is made considering the safety of users typically having a body electrical resistance of about 2 KΩ, when they are exposed to a high voltage, and applies to an image forming apparatus, such as a laser printer. Users of an image forming apparatus can be exposed to a high voltage if: a cover is opened to draw out a print medium, jammed while the image forming apparatus is performing a printing operation; a developing unit, containing toner and a photoconductive drum, is separated from the body of the image forming apparatus; or a transfer unit is separated from the body. In order to protect users, a mechanical cover switch is provided to protect a user in such circumstances.

Various international standards recommend that such a mechanical cover switch should be employed in an image forming apparatus, in order to prevent the image forming apparatus from exposing a user to a high voltage. However, if the mechanical cover switch is used more than a predetermined number of times, the switch can fail when a contact terminal is worn away or becomes inelastic. In such circumstances, while the cover of the image forming apparatus is opened, a user may be exposed to a high voltage, produced in a high voltage generating part, thereby threatening his/her safety. In addition, the mechanical cover switch has a complicated structure that increases production costs.

SUMMARY OF THE INVENTION

Accordingly, it is an aspect of the present invention to provide an image forming apparatus and a power control method thereof, which are capable of protecting a user from an electrical malfunction in the apparatus.

Another aspect of the present invention is to provide an image forming apparatus and a power control method thereof, which can redundantly protect a user against a high voltage, even when a replaceable unit is separated from the apparatus.

Still another aspect of the present invention is to provide an image forming apparatus and a power control method thereof, which are capable of detecting and indicating whether a fuse of a power supply is opened or closed (open/close).

Additional aspects of the present invention will be set forth in part in the description which follows and, in part, will be obvious from the description, or may be learned by practice of the present invention.

The foregoing and/or other aspects of the present invention can be achieved by providing an image forming apparatus comprising: a body; a power supply that generates and outputs a operation voltage; and a controller that controls the output of the operation voltage from the power supply, based on whether the replaceable unit is installed within the body.

According to an aspect of the invention, the image forming apparatus further comprises: a cover that covers the body; a high voltage generating part to receive the operation voltage and output a high voltage; and a cover switch, that is connected to an input terminal of the high voltage generating part, and has an OFF state and an ON state.

According to an aspect of the invention, the controller interrupts the output of the operation voltage, if the replaceable unit is not installed within the body and the cover switch is in the OFF state.

According to an aspect of the invention, the controller detects whether the cover switch is in one of the OFF state and the ON state by detecting a voltage at the input terminal of the high voltage generating part.

According to an aspect of the invention, the controller permits the output of the operation voltage if the replaceable unit is installed within the body.

According to an aspect of the invention, the image forming apparatus further comprises a relay connector comprising a plug and an electronic outlet, for signal transmission between the replaceable unit and the controller.

According to an aspect of the invention, the controller determines whether the replaceable unit is installed within the body, based on whether an installation signal, transmitted from the controller to the replaceable unit, returns from the replaceable unit to the controller.

According to an aspect of the invention, the image forming apparatus further comprises an electronic unit; an electronic unit driving part to receive the operation voltage and regulate a driving voltage supplied to the electronic unit; and a switching device that prevents the operation voltage from being supplied to the electronic unit driving part.

According to an aspect of the invention, the controller controls the switching device to prevent the operation voltage from being supplied to the electronic unit driving part, if the controller receives an error signal from the replaceable unit.

According to an aspect of the invention, the image forming apparatus further comprises a print medium jam detecting part. The controller controls the switching device to prevent the operation voltage from being supplied to the electronic unit driving part, if a print medium jam is detected.

According to an aspect of the invention, the switching device comprises a relay.

According to an aspect of the invention, the controller outputs a disable signal to the power supply, to cut off the operation voltage.

According to an aspect of the invention, the power supply comprises a first converter that generates a first operation voltage to be supplied to the high voltage generating part and a second converter that generates a second operation voltage to be supplied to the electronic unit driving part.

According to an aspect of the invention, the controller outputs the disable signal to the power supply, to cut off the first and second operation voltages, of the first and second converters, respectively.

According to an aspect of the invention, the controller outputs the disable signal to the power supply, to cut off the second operation voltage of the second converter, if the controller receives an error signal from the replaceable unit.

According to an aspect of the invention, fuses are connected to output terminals of the first and second converters, respectively.

According to an aspect of the invention, the controller detects a voltage at the input terminal of the electronic unit driving part and determines whether the fuse connected to the output terminal of the second converter is opened.

The foregoing and/or other aspects of the present invention can be achieved by providing a power control method for an image forming apparatus having a replaceable unit, a high voltage generating part, and an electronic unit driving part. The method can comprise: outputting a operation voltage to be supplied to the high voltage generating part and the electronic unit driving part; detecting whether a replaceable unit is installed within the apparatus; and interrupting an operation voltage, if the replaceable unit is not installed within the apparatus.

According to an aspect of the invention, the power control method further comprises a detecting whether a cover of the image forming apparatus is opened or closed; and interrupting the outputting of the operation voltage if the cover is opened and/or the replaceable unit is not installed.

According to an aspect of the invention, the off state of the cover switch is determined based on a voltage detected at the input terminal of the high voltage generating part.

According to an aspect of the invention, the power control method further comprises generating and outputting the operation voltage, if the replaceable unit is installed within the apparatus.

According to an aspect of the invention, the detecting of the replaceable unit installed within the apparatus is determined based on whether a determination signal, of installation transmitted to the replaceable unit, returns from the replaceable unit.

According to an aspect of the invention, the power control method further comprises preventing the operation voltage from being supplied to the electronic unit driving part, if an error signal is output from the replaceable unit.

The foregoing and/or other aspects of the present invention can be achieved by providing an image forming apparatus comprising: a body; a cover disposed upon the body; an electronic unit; a power supply to output an operation voltage; an electronic unit driving part to receive the operation voltage and regulate a driving voltage supplied to the electronic unit; and a controller to control the output of the operation voltage from the power supply, based on whether a replaceable unit is installed within the body and whether the cover is opened or closed.

According to an aspect of the invention, the controller interrupts the output of the operation voltage from the power supply when the cover is open and/or the replaceable unit is not installed within the body.

According to an aspect of the invention, the image forming apparatus further comprises a switching device to interrupt the output of the operation voltage to the electronic unit driving part. The controller controls the switching device to interrupt the output of the operation voltage to the electronic unit driving part if the controller receives an error signal from the replaceable unit.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
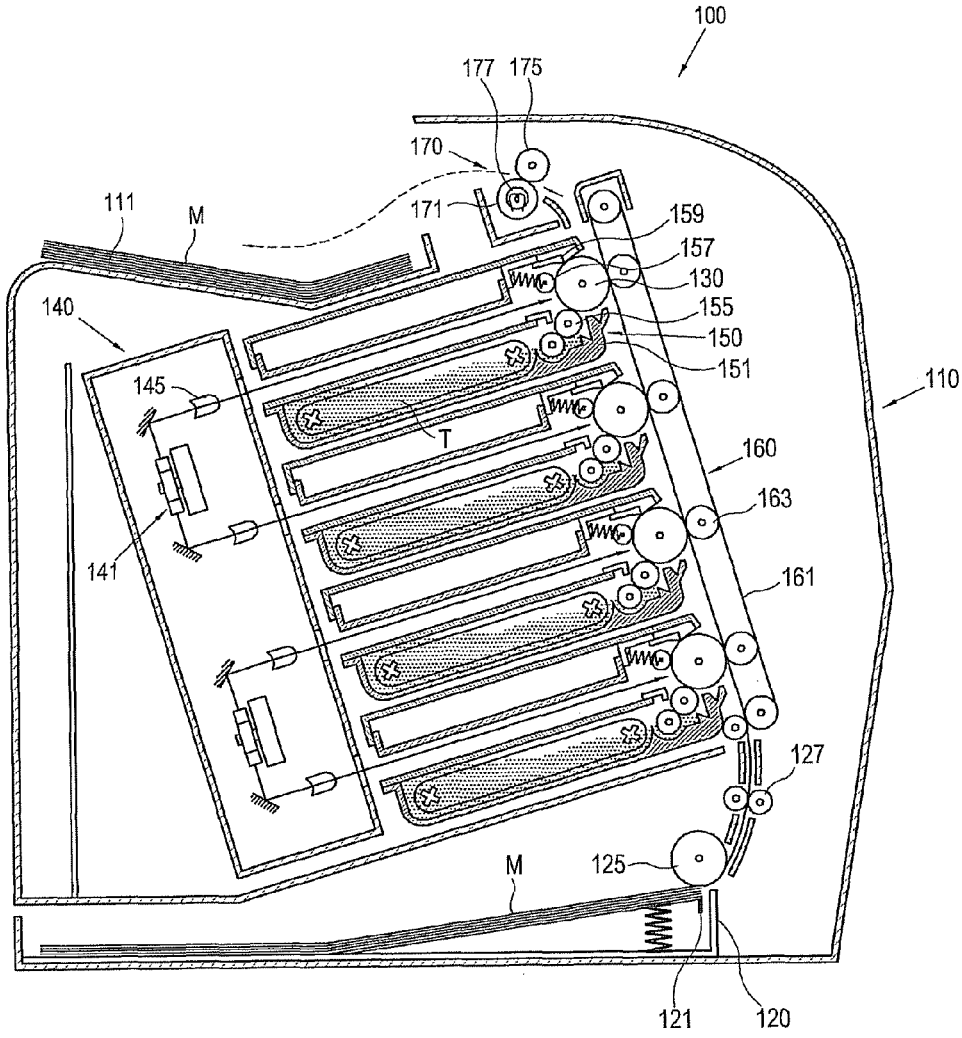
FIG. 1 is a schematic view showing an image forming apparatus, according to an exemplary embodiment of the invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a schematic view showing an image forming apparatus 100 according to an exemplary embodiment of the invention. The image forming apparatus 100 is a color image forming apparatus that employs an electrophotographic system. However, any suitable image forming apparatus may be used, for example a fax machine, a copy machine, a combination machine, or the like. The image forming apparatus 100 comprises: a cabinet 110, a supply unit 120 that is equipped within the cabinet 110, a photoconductor 130, an optical scan unit 140, a developing unit 150, a transfer unit 160, and a fixing unit 170.

The cabinet 110 forms an external surface of the image forming apparatus 100 and includes a discharge unit 111, on to which print media M is collected. The supply unit 120, in which print media M is loaded, can be removably attached to the cabinet 110. The print media M is transferred from the supply unit 120 to the developing unit 150, along a conveyance path. The supply unit 120 raises the print media M, such that when a feeding roller 125 is rotated, single sheets of the print media M are moved by the feeding roller 125 to a transfer roller 127.

The photoconductor 130, provided inside the developing, unit 150, responds to a beam scanned from the optical scan unit 140, to form an electrostatic image on a circumference of the photoconductor 130. The developing unit 150 comprises: a toner container 151 that accumulates toner T; a developing roller 155 that faces the photoconductor 130 and develops the toner T, in a region where the electrostatic latent image of the photoconductor 130 is formed; a supply roller 156 that supplies the toner T to the developing roller 155; and a charger 157 that charges the photoconductor 130 to a predetermined potential. The developing unit 150 further comprises a cleaning blade 159 that removes remaining waste toner from the photoconductor 130.

The developing unit 150 and the photoconductor 130 are prepared for each color, used to form a full color image, according to a single pass system. FIG. 1 illustrates four units to realize yellow (Y), magenta (M), cyan (C) and black (K) colors.

The optical scan unit 140 scans each of photoconductors 130 with a beam, so that electrostatic latent images can be formed on each of the photoconductors 130. The optical scan unit 140 has a multi-beam optical scan structure that simultaneously scans the plurality of photoconductors 130 with a beam.

The transfer unit 160 faces the photoconductor 130. Print medium M, which is conveyed via the conveyance path, is interposed therebetween. The print medium M can be any suitable printable medium, for example, paper, transparency sheets, and the like. The transfer unit 160 transfers a toner image, formed on the photoconductor 130, onto the conveyed print medium M. The transfer unit 160 comprises a transfer belt 161 and transfer backup rollers 163 that face the plurality of photoconductors 130. The toner image, transferred onto the print medium by the transfer unit 160, is fixed by the fixing unit 170.

The fixing unit 170 comprises a heating roller 171, a pressurizing roller 175 and a heat source 177. The surface of the heating roller 171 is heated by the heat source 177. The heat roller 171 fixes the toner image onto the print medium using mutual compression with the pressurizing roller 175.

In order to transfer the toner image, formed on the photoconductor 130, onto the print medium M, the transfer unit 160 faces the photoconductor 130 with print medium M interposed therebetween. The transfer unit 160 is separated from the image forming apparatus 100, if print medium M becomes jammed therein, or if the transfer unit 160 needs to be replaced. The transfer unit 160, the developing unit 150, and the like are consumable parts that are designed to be replaced. In the following description, consumable parts, which can be separated from the image forming apparatus 100, are collectively called a replaceable unit.

Figure 2:
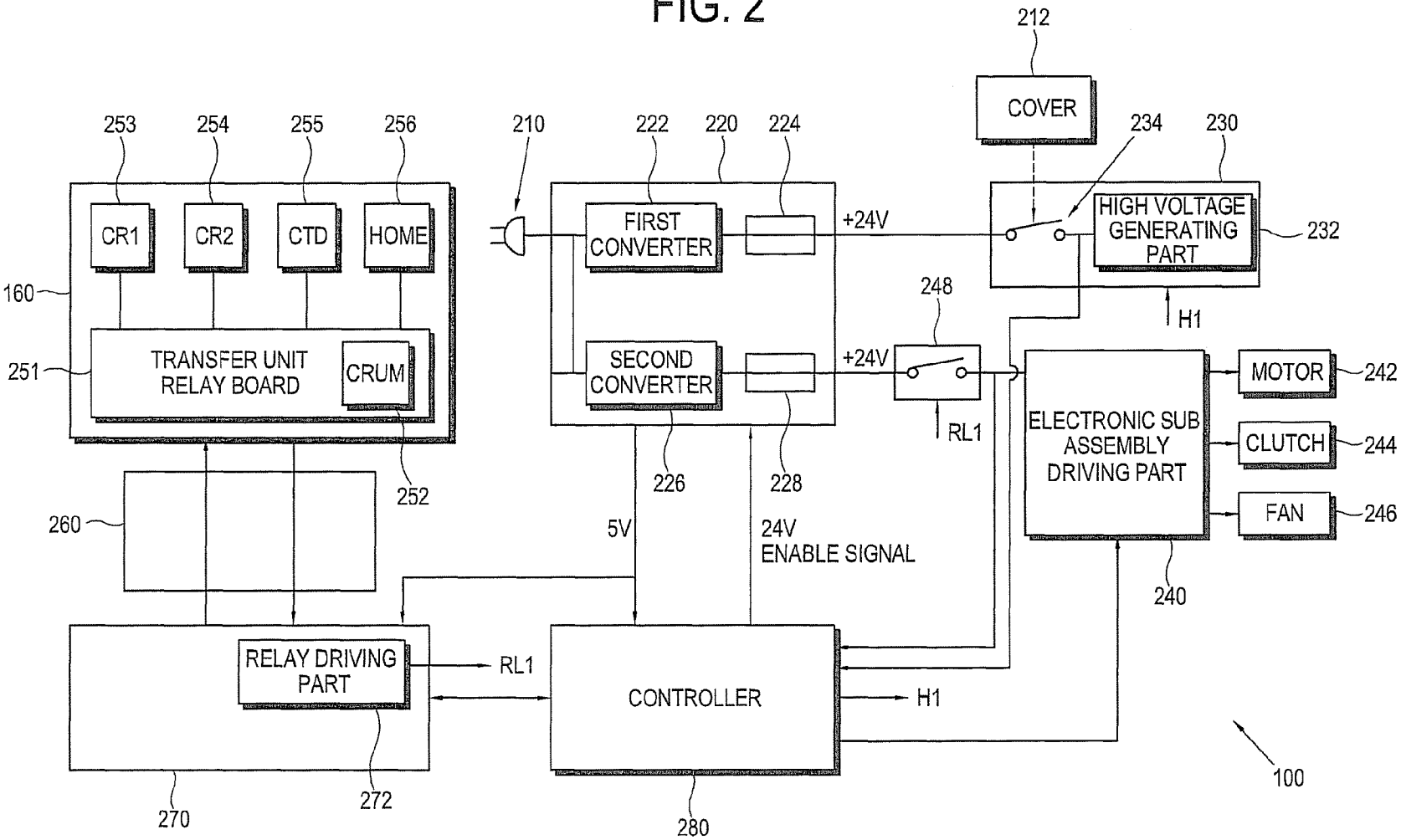
FIG. 2 is a block diagram showing a configuration of an image forming apparatus, according to a first embodiment of the invention.

FIG. 2 is a block diagram showing a configuration of the image forming apparatus 100, according to a first embodiment of the invention. The image forming apparatus 100 comprises a power supply 220, a high voltage generating board 230, an electronic unit driving part 240, a transfer unit 160, a relay connector 260, a transfer unit interface 270, and a controller 280.

The power supply 220 generates and outputs predetermined operation voltages, to be supplied to a high voltage generating part 232, of the high voltage generating board 230, and the electronic unit driving part 240. Electricity is applied to the power supply 220 through a power cord 210. A voltage of 24 V is output for the all operation voltages. The power supply 220 comprises first and second converters 222 and 226, to generate operation voltages. An operation voltage from the first converter 222 is supplied to the high voltage generating part 232, of the high voltage generating board 230. An operation voltage from the second converter 226 is supplied to the electronic unit driving part 240. The power supply 220 generates and outputs voltages of 5 V for the controller 280, the transfer unit interface 270, and the like. Fuses 224 and 228 are connected to output terminals, of the first and second converters 222 and 226, respectively.

The high voltage generating board 230 comprises the high voltage generating part 232 and a cover switch 234 connected to an input terminal of the high voltage generating part 232. The high voltage generating part 232 generates charging high voltages, developing high voltages, and transfer high voltages using the operation voltages generated and output from the power supply 220.

The cover switch 234 interlocks with a cover 212, by a mechanical actuator lever (not shown). When the cover 212 is opened, the cover switch 234 is switched off, to prevent the operation voltage from being supplied to the high voltage generating part 232.

The electronic unit driving part 240 drives electronic units, such as a motor 242, a clutch 244, a fan 246, and the like. The electronic unit driving part 240 drives the electronic units 242, 244 and 246, according to control signals from the controller 280. A relay 248 is connected to an input terminal of the electronic unit driving part 240. The relay 248 comprises a switching device that regulates the 24 V operation voltage output from the second converter 226. When a driving terminal of the relay 248 is switched off, the 24 V operation voltage, output from the second converter 226, is not supplied to the electronic unit driving part 240.

The transfer unit 160, which faces the photoconductor 130, transfers the toner image, formed on the photoconductor 130, onto the print medium M. The transfer unit 160 comprises: a transfer unit relay board 251, including a customer replacement unit monitor (CRUM) memory 252 that stores information related to transfer belt lifetime and ID; color registration (CR) sensors 253 and 254, that detect whether an image for each color is correctly aligned and printed on the print medium M; a color tone density (CTD) sensor 255 that detects toner concentration; a groove detecting sensor 256 that detects grooves of a transfer belt; and other sensors that detect the temperature of the transfer unit 160.

The relay connector 260 comprises a drawer connector that comprises a plug and an electric outlet, for signal transmission between the transfer unit relay board 251 and the transfer unit interface 270. The transfer unit 160 is a replaceable unit, which interlocks with the cover 212, and can be separated from the image forming apparatus 100, by, when the cover 212 is opened. The transfer unit 160 is connected to the transfer unit interface 270, via the relay connector 260.

The transfer unit interface 270 is an interface to interconnect the transfer unit 160 and the controller 280. Whether the transfer unit 160 is installed can be detected by using an installation signal. The installation signal is transmitted from the transfer unit interface 270, to the relay connector 260, and is fed back from the relay connector 260 to the transfer unit interface 270. For example, if the transfer unit 160 is connected to the relay connector 260, the installation signal, transmitted to the relay connector 260, returns to the transfer unit interface 270. If the transfer unit 160 is not connected to the relay connector 260, the installation signal does not return to the transfer unit interface 270. FIG. 2 shows a relay driving part 272 equipped within the transfer unit interface 270. The relay driving part 272 drives the relay 248, which is connected to the input terminal of the electronic unit driving part 240.

The controller 280 controls the high voltage generating part 232, to generate high voltages, such as the charging voltage, the transfer voltage, the developing voltage, and the like. The controller 280 controls the electronic unit driving part 240 to drive the motor 242, the clutch 244, the fan 246, and the like, depending on operation conditions. In addition, the controller 280 controls the power supply 220, to generate and output the operation voltages, to the high voltage generating part 232 or the electronic unit driving part 240. An operation voltage enable signal can be used as shown in FIG. 2.

The controller 280 receives error signals from the transfer unit 160, via the transfer unit interface 270. These error signals may include error signals indicating that the transfer unit 160 is not installed in the image forming apparatus 100 and/or error signals detected by the above-mentioned sensors. The controller 280 detects the operation voltages, at the input terminal of the high voltage generating part 232 and the input terminal of the electronic unit driving part 240, by receiving feedback signals from the operation voltages. The 24 V operation voltages, of the high voltage generating part 232 and the electronic unit driving part 240, are higher than the 5 V operation voltage of the controller 280, the 24 V operation voltages are reduced to about 5 V, by resistors.

Figure 5:
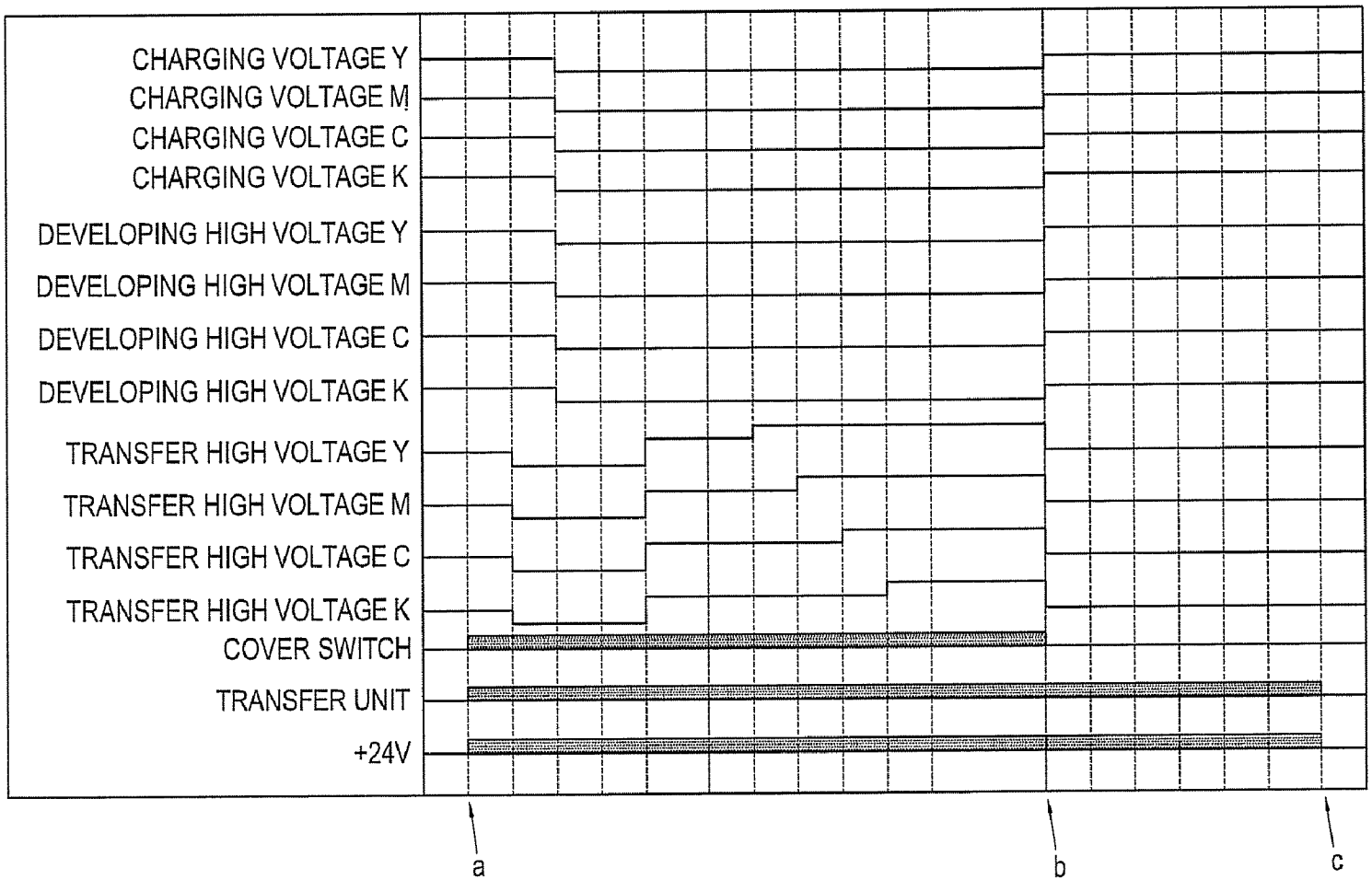
FIG. 5 is a timing diagram showing voltage signals generated in the image forming apparatus shown in FIG. 2.

Hereinafter, an operation of the image forming apparatus 100 shown in FIG. 2 will be described with reference to FIG. 5. An operation of the image forming apparatus 100, when the transfer unit 160 is installed within the apparatus 100 and the cover 212 is closed, will be described. In FIG. 5, 'a' indicates a time when the transfer unit 160 is installed within the apparatus 100 and the cover 212 is closed.

The controller 280 outputs a 24 V enable signal to the power supply 220. The power supply 220 operates the first converter 222 to supply a first 24 V operation voltage to the high voltage generating part 232 and operates the second converter 226 to supply a 24 V second operation voltage to the electronic unit driving part 240. In this case, since the cover 212 remains closed, the cover switch 234 remains in an ON state, and accordingly, the first 24 V operation voltage is supplied to the high voltage generating part 232. In addition, a high charging voltage, a high transfer voltage, and a high developing voltage are generated under the control of the controller 280. The driving terminal, of the relay 248 connected to the input terminal of the electronic unit driving part 240, remains in an ON state, and the second 24 V operation voltage is supplied to the electronic unit driving part 240. The motor 242, the clutch 244, and the fan 246 are operated under control of the controller 280.

Operation of the image forming apparatus 100, when the cover 212 is opened, will now be described. In FIG. 5, 'b' indicates a time when the transfer unit 160 is installed within the apparatus 100 and the cover 212 is opened. When the cover 212 is opened, the cover switch 234 is switched to an OFF state. The 24 V operation voltage is not supplied to the high voltage generating part 232. No voltage is output from the high voltage generating part 232. The controller 280 detects a voltage at the input terminal of the high voltage generating part 232. No voltage is transmitted to the input terminal of the high voltage generating part 232, and the controller 280 determines that the cover 212 is opened.

A case where the transfer unit 160 is not installed with the apparatus 100, will now be described. In FIG. 5, 'c' indicates a time when the transfer unit 160 is not equipped within the apparatus 100 and the cover 212 is opened. When the cover 212 is opened and the transfer unit 160 is detached from the image forming apparatus 100, the transfer unit 160 is disconnected from the relay connector 260. A voltage from a detection terminal is received by the transfer unit interface 270. The voltage received in the transfer unit interface 270 is input to the relay driving part 272, and the driving terminal of the relay 248 is switched to an open state. In addition, the voltage is transmitted to the controller 280.

The controller 280 receives an error signal when determining whether or not the transfer unit 160 is installed within the apparatus 100. If it is determined that the cover 212 is opened and the transfer unit 160 is not installed within the apparatus 100, the controller 280 outputs a disable signal to a 24 V enable terminal of the power supply 220. The first and second converters 222 and 226, of the power supply 220, stop operating, and the operation voltages are not supplied to the high voltage generating part 232 and/or the electronic unit driving 240.

A case where the transfer unit 160 is not installed within the apparatus 100 and the cover 212 is closed, will now be described. When the cover 212 is closed, the cover switch 234 switches to an ON state when interlocked with the cover 212. The controller 280 determines that the transfer unit 160 is not installed within the apparatus 100, although the cover 212 is closed. Accordingly, the controller 280 maintains the disable signal output to the 24 V enable terminal of the power supply 220. If the transfer unit 160 is not equipped within the apparatus 100, it is preferable that the controller 280 outputs the disable signal. However, if there is not an electrocution danger when a replaceable unit is not installed within the apparatus, the controller 280 may output an enabling signal to the 24 V enable terminal. In this case, the driving terminal of the relay 248 remains in an OFF state, through the relay driving part 272 of the transfer unit interface 270.

The following table 1 summarizes supply or interception of the operation voltage of the power supply 220, the high voltage generating part 232, and the electronic unit driving part 240, depending on whether the cover 212 is opened or closed, and whether the transfer unit 160 is installed within the apparatus 100.

TABLE 1

| Cover | Installation of Transfer unit | Power supply | High voltage generating part | Electronic unit driving part |
|---|---|---|---|---|
| Open | Not installed | Interception of operation voltage | — | — |
| Open | installed | Output of operation voltage | Interception of operation voltage | Supply of operation voltage |
| Close | Not installed | Interception of operation voltage | — | — |
| Close | Installed | Output of operation voltage | Supply of operation voltage | Supply of operation voltage |

When the transfer unit 160 is installed within the apparatus 100 and the cover 212 is closed, if an error signal is output from the transfer unit 160, the controller 280 maintains the enable signal, because the first converter 222 and the second converter 226 are not necessary to stop its operation. The relay driving part 272 is controlled by the error signal, the driving terminal of the relay 248 switches to an OFF state, thereby preventing the second 24 V operation voltage from being supplied to the electronic unit driving part 240.

When the transfer unit 160 is installed within the apparatus 100, and the cover 212 is closed, if the second operation voltage is not detected at the input terminal, of the electronic unit driving part 240, the controller 280 determines that the fuse 228 is blown, and generates an alarm signal and/or displays an alarm message on a display (not shown).

Figure 3:
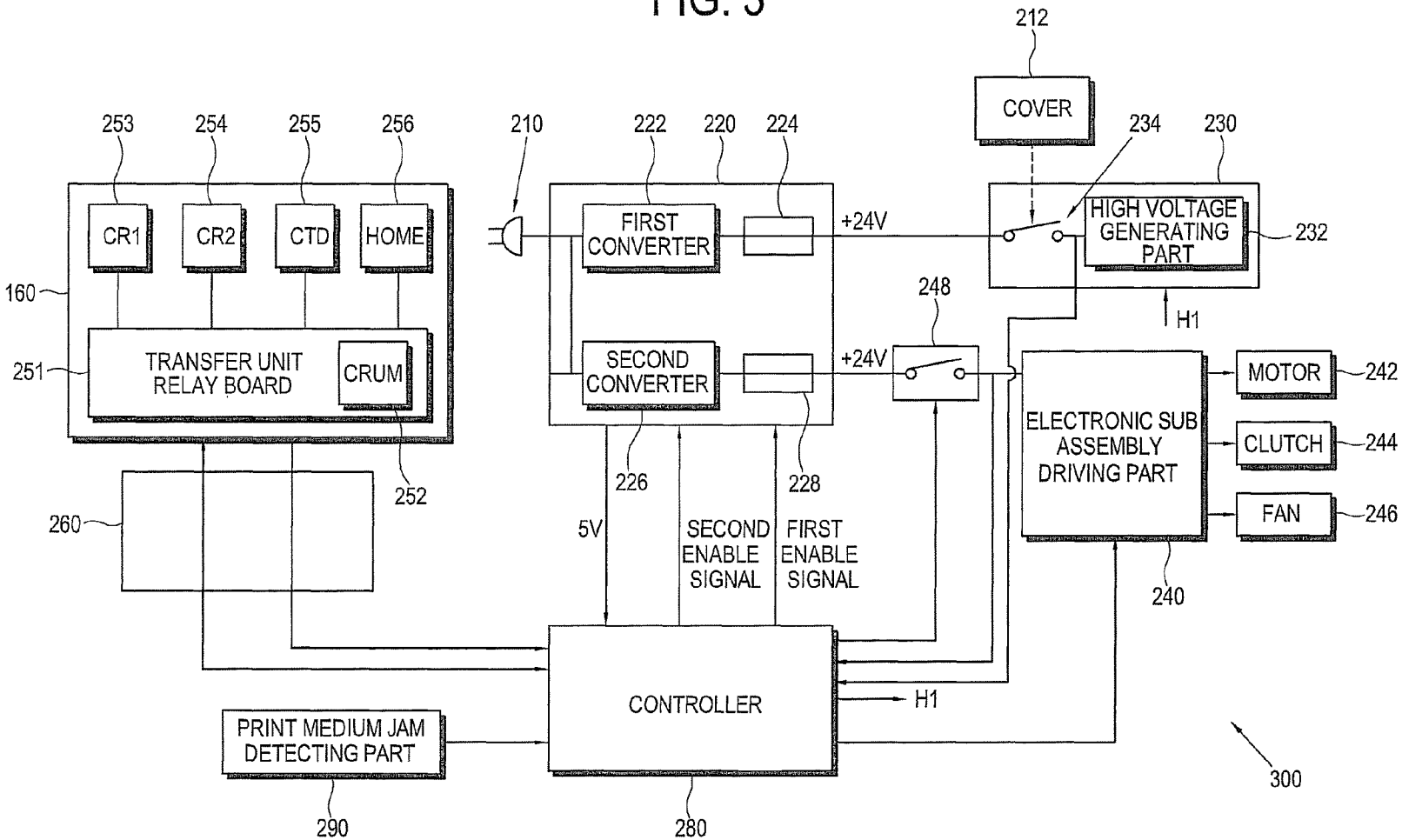
FIG. 3 is a block diagram showing a configuration of an image forming apparatus, according to a second embodiment of the invention.

FIG. 3 is a block diagram showing a configuration of an image forming apparatus 300, according to a second embodiment of the invention. The image forming apparatus 300 has generally the same configuration as the image forming apparatus 100, shown in FIG. 2, except that the transfer unit interface 270 is replaced with a print medium jam detecting part 290, and two enable signals are generated. An explanation of components, similar to the components shown in FIG. 2, is omitted.

Since the transfer unit interface 270, of the apparatus 100, is not present in the image forming apparatus 300, the controller 280 exchanges signals with the transfer unit 160, via the relay connector 260. If the controller 280 receives an error signal from the transfer unit 160, the controller 280 outputs a relay driving voltage. Accordingly, the driving terminal of the relay 248 switches to an OFF state, thereby preventing the second 24 V operation voltage from being supplied to the electronic unit driving part 240.

The print medium jam detecting part 290 detects whether a print medium is jammed during printing and outputs a result of the detection to the controller 280. If a jam is detected, the controller 280 outputs the relay driving voltage, to prevent the second 24 V operation voltage from being supplied to the electronic unit driving part 240. Accordingly, the driving terminal of the relay 248 switches to an OFF state, thereby preventing the second 24 V operation voltage from being supplied to the electronic unit driving part 240.

The controller 280 outputs a first enable/disable signal to the power supply 220, in order to control the operation of the first converter 222, and outputs a second enable/disable signal to the power supply 220, in order to control the operation of the second converter 226.

Figure 4:
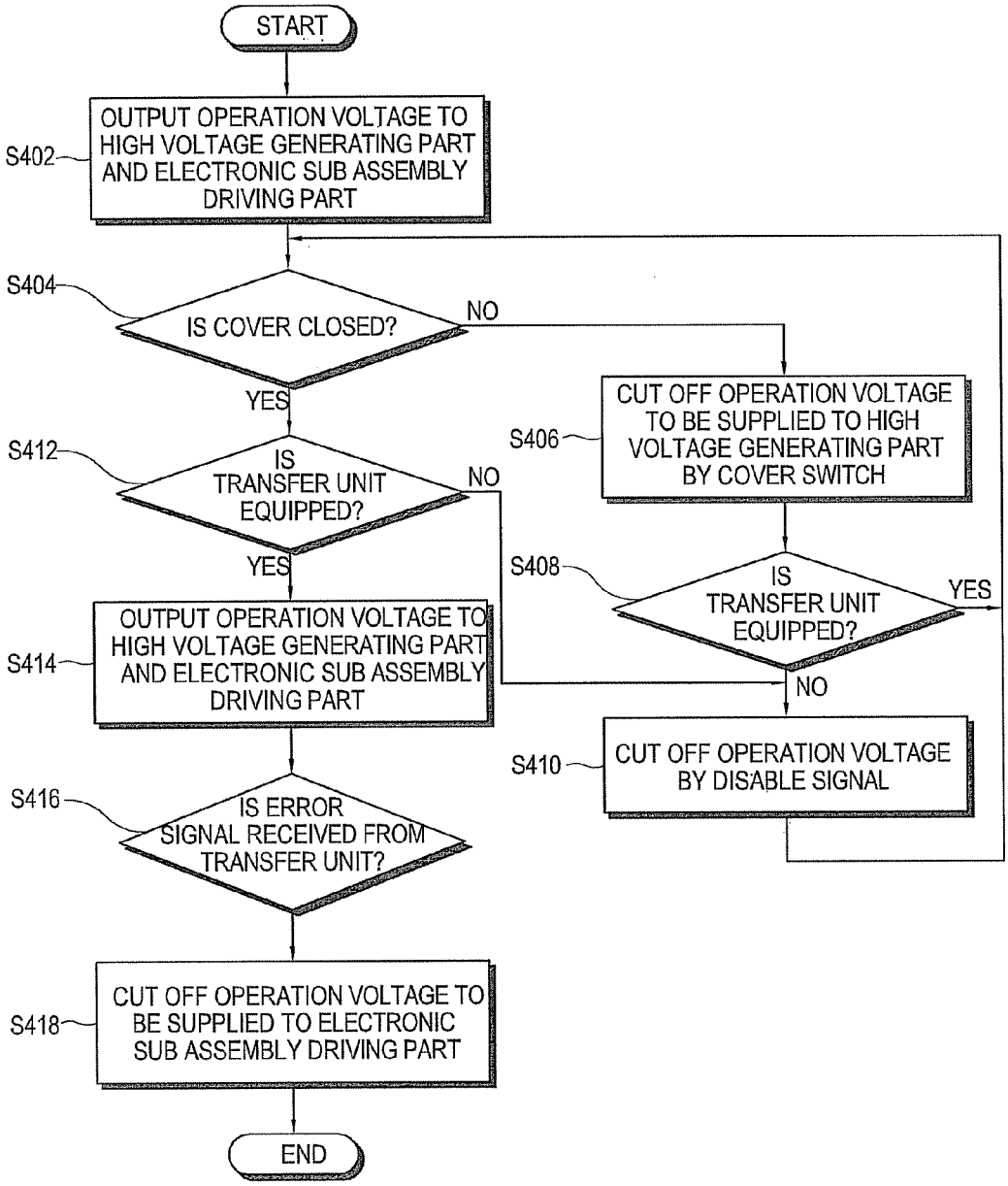
FIG. 4 is a flow chart illustrating a power control method of the image forming apparatus, according to the exemplary embodiment of the present invention.

FIG. 4 is a flow chart illustrating a power control method of an image forming apparatus, according to an exemplary embodiment of the invention. In operation S402, upon receiving a 24 V enable signal from the controller, the power supply 220 generates and outputs operation voltages, to the high voltage generating part 232 and the electronic unit driving part 240. In operation S404, the controller 280 determines whether the cover switch 234 is in an ON state. It is preferable, but not necessary, that the open or closed state of the cover 212 is determined by detecting an input terminal voltage of the high voltage generating part 232. In operation S406, if the cover switch 234 is switched off, the operation voltage not supplied to the high voltage generating part 232.

In operation S408, the controller 280 determines whether or not the transfer unit 160 is installed within the apparatus 100. Whether the transfer unit 160 is installed is determined based on whether an installation signal, transmitted from the controller 280 to the transfer unit 160, is received from the transfer unit 160. If the transfer unit 160 is installed within the apparatus 100, the method proceeds to operation S404. If the transfer unit 160 is not installed within the apparatus 100, the method proceeds to operation S410. In operation S410, the controller 280 outputs a disable signal to the power supply 220, to prevent the operation voltages from being supplied to the high voltage generating part 232 and the electronic unit driving part 240.

In operation S414, if the cover 212 is closed, the controller 280 determines whether the transfer unit 160 is installed within the apparatus 100. If the transfer unit 160 is not installed within the apparatus 100, the controller 280 outputs the disable signal to the power supply 220, to prevent the operation voltages from being supplied to the high voltage generating part 232 and the electronic unit driving part 240. In operation S414, if the transfer unit 160 is installed within the apparatus 100, the controller 280 outputs an enable signal to the power supply 220, to generate and output the operation voltages, to be supplied to the high voltage generating part 232 and the electronic unit driving part 240.

The controller 280 receives a signal from the transfer unit 160 and determines whether there is an error in the transfer unit 160, based on the signal received at operation S416. In operation S418, if an error is detected, the controller 280 prevents the second operation voltage from being supplied to the electronic unit driving part 240.

As is apparent from the above description, aspects of the present invention provide an image forming apparatus and a power control method thereof, which are capable of preventing a user from being in danger, by cutting off power to a high voltage generating part, when a cover is opened. In addition, aspects of the present invention provide an image forming apparatus and a power control method thereof, which are capable of doubly protecting a user, against a malfunction, if a replaceable unit is not installed within the apparatus. Further, aspects of the present invention provide an image forming apparatus and a power control method thereof, which are capable of detecting and indicating whether a fuse of a power supply is open or closed.

Although a few embodiments of the present invention have been shown and described, it will be appreciated by those skilled in the art that changes may be made in these embodiments without departing from the principles and spirit of the invention, the scope of which is defined in the claims and their equivalents.

What is claimed is:

1. An image forming apparatus comprising:

a body;

a power supply to output an operation voltage;

a controller to control the output of the operation voltage from the power supply, based on whether a replaceable unit is installed within the body;

a cover that covers the body;

a high voltage generating part to receive the operation voltage and output a high voltage; and a cover switch that is connected to an input terminal of the high voltage generating part, interlocks with the cover, and has an OFF state and an ON state, wherein the controller detects whether the cover switch is in one of the OFF state and the ON state by detecting a voltage at the input terminal of the high voltage generating part.

2. The image forming apparatus according to claim 1, wherein the controller interrupts the output of the operation voltage if the replaceable unit is not installed within the body and the cover switch is in the OFF state.

3. The image forming apparatus according to claim 2, wherein the controller permits the output of the operation voltage if the replaceable unit is installed within the body.

4. The image forming apparatus according to claim 2, wherein the controller outputs a disable signal to the power supply to interrupt the operation voltage.

5. The image forming apparatus according to claim 1, further comprising a relay connector comprising a plug and an electronic outlet, to transmit signals between the replaceable unit and the controller.

6. An image forming apparatus comprising:

a body;

a power supply to output an operation voltage;

a controller to control the output of the operation voltage from the power supply, based on whether a replaceable unit is installed within the body;

a relay connector comprising a plug and an electronic outlet, to transmit signals between the replaceable unit and the controller, wherein the controller is to determine whether the replaceable unit is installed within the body based on whether an installation signal transmitted from the controller to the replaceable unit, returns from the replaceable unit to the controller;

an electronic unit;

an electronic unit driving part to receive the operation voltage and regulate a driving voltage supplied to the electronic unit; and a switching device to interrupt the output of the operation voltage to the electronic unit driving part, wherein the controller controls the switching device to interrupt the output of the operation voltage to the electronic unit driving part if the controller receives an error signal from the replaceable unit.

7. The image forming apparatus according to claim 6, further comprising a print medium jam detecting part to detect a print medium jam, wherein the controller controls the switching device to interrupt the output of the operation voltage to the electronic unit driving part, if the print medium jam is detected by the print medium jam detecting part.

8. The image forming apparatus according to claim 6, wherein the switching device comprises a relay.

9. An image forming apparatus comprising:

a body;

a power supply to output an operation voltage;

a controller to control the output of the operation voltage from the power supply, based on whether a replaceable unit is installed within the body;

a cover that covers the body;

a high voltage generating part to receive the operation voltage and output a high voltage;

a cover switch that is connected to an input terminal of the high voltage generating part, interlocks with the cover, and has an OFF state and an ON state, wherein the controller outputs a disable signal to the power supply to interrupt the operation voltage, and wherein the power supply comprises a first converter to supply a first operation voltage to the high voltage generating part and a second converter to supply a second operation voltage to an electronic unit driving part.

10. The image forming apparatus according to claim 9, wherein the controller outputs the disable signal to the power supply to interrupt the first and second operation voltages.

11. The image forming apparatus according to claim 10, wherein the controller outputs the disable signal to the power supply to interrupt the second operation voltage, if the controller receives an error signal from the replaceable unit.

12. The image forming apparatus according to claim 9, further comprising fuses connected to output terminals of the first and second converters.

13. The image forming apparatus according to claim 12, wherein the controller detects a voltage at the input terminal of the electronic unit driving part and determines whether the fuse connected to the output terminal of the second converter is opened based on the voltage.

14. A power control method of an image forming apparatus having a controller, a high voltage generating part, and an electronic unit driving part, comprising:

outputting an operation voltage to the high voltage generating part and the electronic unit driving part;

detecting whether a replaceable unit is installed within the apparatus;

interrupting the outputting of the operation voltage to the electronic unit driving part if an error signal is output from the replaceable unit because the replaceable unit is not installed, wherein the controller controls a switching device to interrupt the output of the operation voltage to the electronic unit driving part if the controller receives an error signal from the replaceable unit.

15. The power control method according to claim 14, further comprising:

detecting whether a cover of the image forming apparatus is opened or closed; and interrupting the outputting of the operation voltage if the cover is opened and/or the replaceable unit is not installed.

16. The power control method according to claim 15, wherein the detecting of whether the cover is opened or closed further comprises detecting whether a voltage is output through the switch integrated with the cover, to an input terminal of the high voltage generating part.

17. The power control method according to claim 14, further comprising outputting the operation voltage if the replaceable unit is detected within the apparatus.

18. The power control method according to claim 17, wherein the detecting of the replaceable unit further comprises determining whether an installation signal transmitted to the replaceable unit returns from the replaceable unit.

19. An image forming apparatus comprising:

a body;

a cover disposed upon the body;

an electronic unit;

a power supply to output an operation voltage;

an electronic unit driving part to receive the operation voltage and regulate a driving voltage supplied to the electronic unit; and a controller to control the output of the operation voltage from the power supply, based on whether a replaceable unit is installed within the body and whether the cover is opened or closed; and a switching device to interrupt the output of the operation voltage to the electronic unit driving part, wherein the controller controls the switching device to interrupt the output of the operation voltage to the electronic unit driving part if the controller receives an error signal from the replaceable unit.

20. The image forming apparatus according to claim 19, wherein:

the controller interrupts the output of the operation voltage from the power supply when the cover is open and/or the replaceable unit is not installed within the body.

* * * * *

UNITED STATES PATENT AND TRADEMARK OFFICE

CERTIFICATE OF CORRECTION

PATENT NO. : 7,856,186 B2
APPLICATION NO. : 11/942092
DATED : December 21, 2010
INVENTOR(S) : Yoon-seop Eom It is certified that error appears in the above-identified patent and that said Letters Patent is hereby corrected as shown below:

Column 12, Line 36 (Approx.), In Claim 19, after "unit;" delete "and".

Signed and Sealed this
Twenty-sixth Day of April, 2011

David J. Kappos

David J. Kappos
*Director of the United States Patent and Trademark Office*